US012490799B2

(12) United States Patent
Tateno et al.

(10) Patent No.: US 12,490,799 B2
(45) Date of Patent: Dec. 9, 2025

(54) PLATE, SOLE, AND SHOE

(71) Applicant: ASICS CORPORATION, Kobe (JP)

(72) Inventors: Kenta Tateno, Kobe (JP); Kenji Hirata, Kobe (JP); Hiroaki Nishimura, Kobe (JP); Takayuki Kogure, Kobe (JP)

(73) Assignee: ASICS CORPORATION, Kobe (JP)

( * ) Notice: Subject to any disclaimer, the term of this patent is extended or adjusted under 35 U.S.C. 154(b) by 122 days.

(21) Appl. No.: 17/663,795

(22) Filed: May 17, 2022

(65) Prior Publication Data

US 2022/0378145 A1 Dec. 1, 2022

(30) Foreign Application Priority Data

May 26, 2021 (JP) ..... 2021-088499

(51) Int. Cl.
*A43B 13/12* (2006.01)
*A43B 13/18* (2006.01)

(52) U.S. Cl.
CPC ..... *A43B 13/125* (2013.01); *A43B 13/127* (2013.01); *A43B 13/186* (2013.01)

(58) Field of Classification Search
CPC ..... A43B 13/125; A43B 13/127; A43B 13/16; A43B 13/181; A43B 13/41; A43B 13/026; A43B 13/186; A43B 13/183
USPC ..... 36/107, 108
See application file for complete search history.

(56) References Cited

U.S. PATENT DOCUMENTS 2,072,828 A 3/1937 Schmidt
8,181,364 B2 * 5/2012 Mayden ..... A43B 13/26 36/35 R
2004/0168350 A1 * 9/2004 Mathieu ..... A43B 13/12 36/28
2008/0052965 A1 * 3/2008 Sato ..... A43B 13/026 36/103
2010/0199523 A1 * 8/2010 Mayden ..... A43B 21/32 36/114
2012/0079747 A1 * 4/2012 Seo ..... A43B 13/183 36/25 R (Continued)

FOREIGN PATENT DOCUMENTS

EP 4162833 A1 4/2023
JP 62200903 * 12/1987 ..... A43B 5/00

(Continued)

OTHER PUBLICATIONS

EP Communication of Search Report dated Sep. 8, 2022 for Application No. 22168164.6-1015, 8 pp.

(Continued)

*Primary Examiner* — Haley A Smith
(74) *Attorney, Agent, or Firm* — KONRAD, RAYNES, DAVDA & VICTOR LLP; Alan S. Raynes

(57) ABSTRACT

A plate is used for a sole that forms a part of a shoe. The plate includes a mid- and rear-foot support portion in a shape extending from a position superimposed on a rear end portion of a metatarsal bone of a wearer of the shoe in a thickness direction of the sole to a position superimposed on a heel bone of the wearer, the mid- and rear-foot support portion supporting a midfoot portion and a rear foot portion of the wearer. The mid- and rear-foot support portion is in a shape convex upward in a cross-section in a foot width direction.

20 Claims, 26 Drawing Sheets

(56) References Cited

U.S. PATENT DOCUMENTS

| | | | | |
|---|---|---|---|---|
| 2014/0115925 | A1* | 5/2014 | Hurd | A43B 13/125<br>156/182 |
| 2014/0290098 | A1* | 10/2014 | Loverin | A43B 13/37<br>36/27 |
| 2016/0081427 | A1 | 3/2016 | Iuchi et al. | |
| 2018/0255870 | A1 | 9/2018 | Oda et al. | |
| 2020/0305543 | A1* | 10/2020 | Kajiwara | A43B 13/023 |

FOREIGN PATENT DOCUMENTS

| | | | |
|---|---|---|---|
| JP | 62200903 | U | 12/1987 |
| JP | 2004243132 | A | 9/2004 |
| JP | 2014236886 | A | 12/2014 |
| JP | 2017064246 | A | 4/2017 |
| JP | 6598384 | B2 | 10/2019 |
| WO | 2014066369 | A2 | 5/2014 |

OTHER PUBLICATIONS

EP Communication Pursuant to Article94(3) EPC dated Jun. 21, 2023 for Application No. 22168164.6-1015, 6 pp.
English machine translation of JP6598384B2.
Japanese Notice of Reasons for Refusal, shipping date Sep. 3, 2024, 9 pp. (including translation), for Application No. 2021-088499.

* cited by examiner

PLATE, SOLE, AND SHOE

This nonprovisional application is based on Japanese Patent Application No. 2021-088499 filed with the Japan Patent Office on May 26, 2021, the entire contents of which are hereby incorporated by reference.

BACKGROUND OF THE INVENTION

Field of the Invention

This disclosure relates to a plate, a sole, and a shoe.

Description of the Background Art

A shoe including a plate provided within a midsole has conventionally been known. For example, Japanese Patent No. 6598384 discloses a sole structure of footwear including an upper sole portion, a lower sole portion, and a plate member arranged between the upper sole portion and the lower sole portion. The plate member includes a rear foot part opposed to a rear foot portion of a user. A cross-section in a foot width direction of the rear foot part is formed as being convex downward.

SUMMARY OF THE INVENTION

For the shoe as described in Japanese Patent No. 6598384, in order to enhance shock absorbing performance at the time of landing, a weight or a hardness of a material of which the midsole is composed may be reduced. In this case, from a point of view of preventing injuries or maintaining performance of a wearer, higher stability of the shoe is demanded. This object can be achieved, for example, by suppressing sinking down of an arch portion and a heel during a period from landing until take-off (which is also referred to as "toe-off").

An object of the present disclosure is to provide a plate, a sole, and a shoe capable of achieving suppression of sinking down of an arch portion and a heel during a period from landing until take-off.

A plate according to one aspect of this disclosure is a plate used for a sole that forms a part of a shoe, and the plate includes a mid- and rear-foot support portion in a shape extending from a position superimposed on a rear end portion of a metatarsal bone of a wearer of the shoe in a thickness direction of the sole to a position superimposed on a heel bone of the wearer, the mid- and rear-foot support portion supporting a midfoot portion and a rear foot portion of the wearer. The mid- and rear-foot support portion is in a shape convex upward in a cross-section in a foot width direction.

A sole according to one aspect of this disclosure includes the plate and a midsole that forms a part of the sole. The midsole includes a lower midsole and an upper midsole connected on the lower midsole. The mid- and rear-foot support portion is arranged between the lower midsole and the upper midsole. The lower midsole includes a lower heel region superimposed on a heel portion of the wearer in the thickness direction. The upper midsole includes an upper heel region superimposed on the heel portion of the wearer in the thickness direction. A thickness of the lower heel region is larger than a thickness of the upper heel region.

A sole according to another aspect of this disclosure includes the plate and a midsole that forms a part of the sole. The midsole includes an accommodation portion that defines a space where the plate is accommodated.

A shoe according to one aspect of this disclosure includes the sole and an upper connected to the sole and located above the sole.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
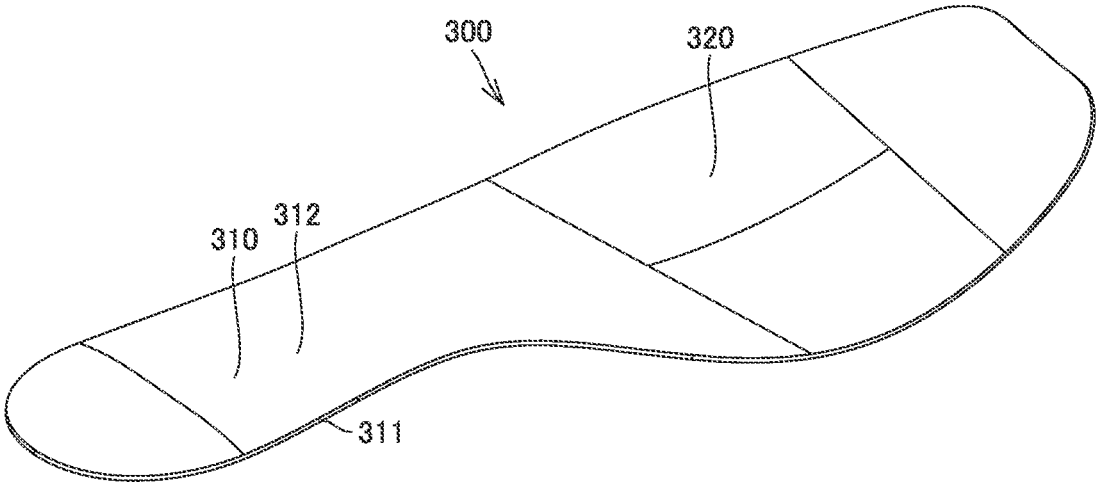
FIG. 1 is a perspective view schematically showing a plate used in a shoe in a first embodiment of the present disclosure.

An embodiment of this disclosure will be described with reference to the drawings. The same or corresponding members in the drawings referred to below have the same reference characters allotted. In the description below, such terms as a foot length direction, a foot width direction, front, and rear are used. The terms indicating directions refer to directions viewed from a point of view of a wearer who wears a shoe 1 placed on a flat plane such as the ground. For example, the front refers to a toe side and the rear refers to a heel side. In addition, an inner side refers to an inner side of a foot (a first toe side of a foot) in the foot width direction and an outer side refers to an outer side of the foot in the foot width direction.

First Embodiment

Figure 2:
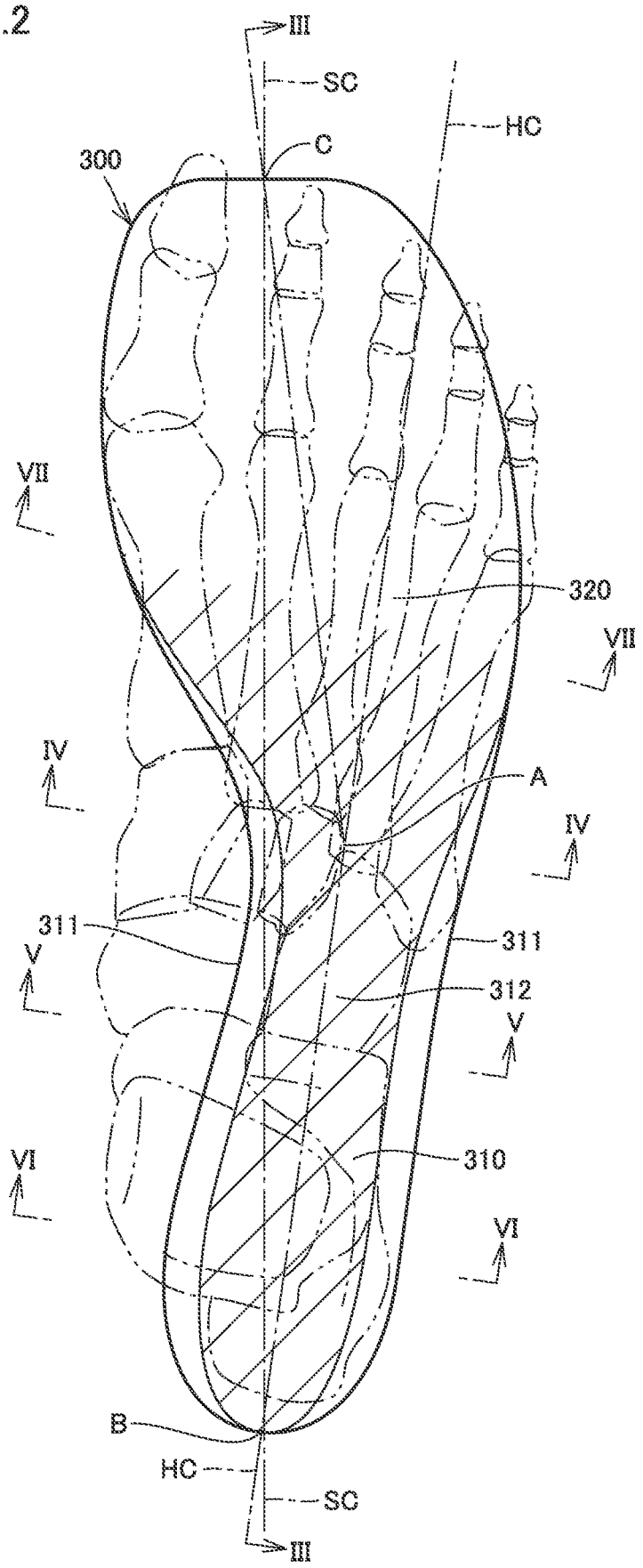
FIG. 2 is a plan view showing relation between the plate and a bone of a foot of a wearer of the shoe.
Figure 3:
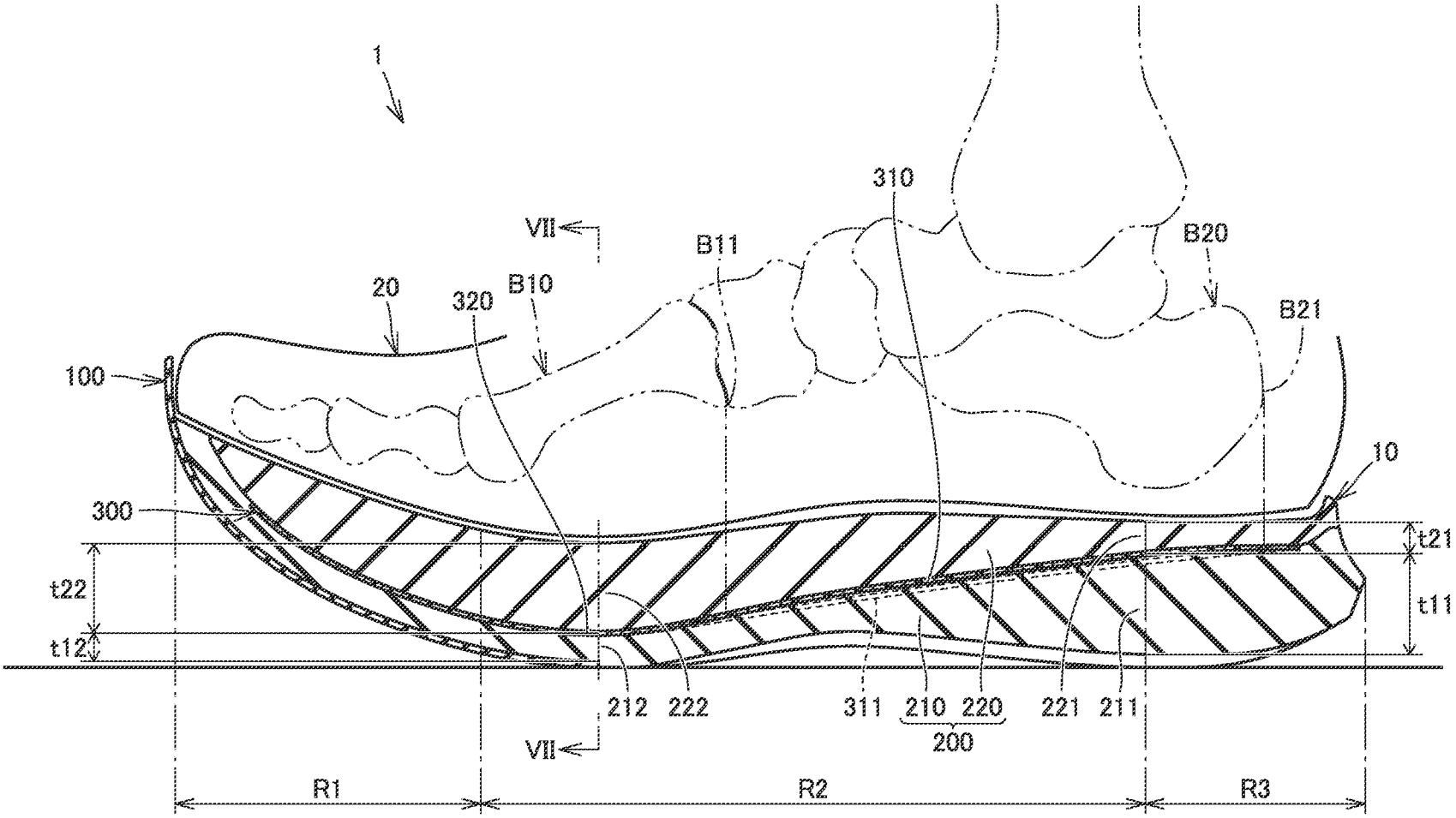
FIG. 3 is a cross-sectional view along the line in FIG. 2.

FIG. 1 is a perspective view schematically showing a plate used in a shoe in a first embodiment of the present disclosure. FIG. 2 is a plan view showing relation between the plate and a bone of a foot of a wearer of the shoe. FIG. 3 is a cross-sectional view along the line in FIG. 2.

FIG. 1 shows a plate 300 for a left foot and FIG. 2 shows the plate 300 for a right foot. The plates are in a shape symmetrical to each other. This is also applicable to a sole 10 and the shoe 1 including the plate 300. The shoe 1 in the present embodiment is applicable, for example, as a sports shoe for such sports as running and a walking shoe, and the shoe 1 may be used in any application.

As shown in FIG. 3, the shoe 1 includes the sole 10 and an upper 20.

The upper 20 is connected to the sole 10, and defines, together with the sole 10, a space where a foot of a wearer is accommodated.

As shown in FIG. 3, the sole 10 includes an outer sole 100, a midsole 200, and the plate 300.

The outer sole 100 forms a grounding portion. The outer sole 100 is composed of rubber, a thermoplastic resin, or the like.

The midsole 200 is provided on the outer sole 100. The midsole 200 is formed of a foamed material or the like made of a resin. The upper 20 is arranged on the midsole 200. In other words, the midsole 200 is provided between the upper 20 and the outer sole 100. As shown in FIG. 3, the midsole 200 includes a forefoot region R1, a midfoot region R2, and a rear foot region R3.

The forefoot region R1 is a region superimposed on a forefoot portion of a wearer of the shoe 1 in a thickness direction of the sole 10. The forefoot portion refers to a part of the foot of the wearer that is located in a front portion in a longitudinal direction, that is, a foot length direction (an upward/downward direction in FIG. 2) of the shoe 1. The forefoot region R1 is a region located within a range approximately from 0% to 30% of the entire length of the shoe 1 from a front end portion toward a rear end portion of the shoe 1.

The foot length direction is a direction in parallel to a shoe center SC (see FIG. 2). The shoe center SC is not limited to a centerline of the shoe 1 but may be a line corresponding to a straight line that connects the center of a heel bone of a standard wearer of the shoe 1 to a position between the first toe and the second toe.

The midfoot region R2 refers to a region superimposed on a midfoot portion of the wearer of the shoe 1 in the thickness direction of the sole 10. The midfoot portion is a part of the foot of the wearer that is located in a central portion in the longitudinal direction. The midfoot region R2 refers to a region located within a range approximately from 30% to 80% of the entire length of the shoe 1 from a tip end portion toward the rear end portion of the shoe 1.

The rear foot region R3 refers to a region superimposed on a rear foot portion of the wearer of the shoe 1 in the thickness direction of the sole 10. The rear foot portion is a part of the foot of the wearer that is located in a rear portion in the longitudinal direction. The rear foot region R3 is a region located within a range from 80% to 100% of the entire length of the shoe 1 from the front end portion toward the rear end portion of the shoe 1.

As shown in FIG. 3, the midsole 200 includes a lower midsole 210 and an upper midsole 220.

The lower midsole 210 is provided on the outer sole 100. In other words, the lower midsole 210 has a lower surface covered with the outer sole 100. The lower midsole 210 may have the lower surface only partly covered with the outer sole 100, rather than entirely.

The lower midsole 210 is composed, for example, of a foamed body of a polyolefin resin, EVA, or a polyamide-based thermoplastic elastomer (TPA or TPAE). The lower midsole 210 has a compression modulus, preferably, not lower than 0.35 MPa and not higher than 2.5 MPa.

The lower midsole 210 includes a lower heel region 211 superimposed on a heel portion of the wearer in the thickness direction of the sole 10 and a lower middle region 212 superimposed on a metatarsal bone B10 of the wearer in the thickness direction of the sole 10. The lower heel region 211 is provided in a rear portion of the midfoot region R2 or in the rear foot region R3. The lower middle region 212 is provided in a rear portion of the forefoot region R1 or in the midfoot region R2. A thickness t11 of the lower heel region 211 is larger than a thickness t12 of the lower middle region 212.

The upper midsole 220 is connected on the lower midsole 210. The upper midsole 220 includes an upper heel region 221 superimposed on the heel portion of the wearer in the thickness direction and an upper middle region 222 superimposed on the metatarsal bone B10 of the wearer in the thickness direction of the sole 10. The upper heel region 221 is formed directly on the lower heel region 211. The upper middle region 222 is formed directly on the lower middle region 212. A thickness t21 of the upper heel region 221 is smaller than a thickness t22 of the upper middle region 222.

The thickness t11 of the lower heel region 211 is larger than the thickness t21 of the upper heel region 221. The thickness t12 of the lower middle region is smaller than the thickness t22 of the upper middle region 222.

The upper midsole 220 is composed, for example, of a foamed body of a polyolefin resin, EVA, or a polyamide-based thermoplastic elastomer (TPA or TPAE). The upper midsole 220 may be higher in compression modulus than the lower midsole 210. The upper midsole 220 has the compression modulus preferably not lower than 0.35 MPa and not higher than 2.5 MPa and more preferably not higher than 1 MPa. The upper midsole 220 may be equal in compression modulus to the lower midsole 210 or may be lower in compression modulus than the lower midsole 210. Though the upper midsole 220 and the lower midsole 210 are formed of the same material, they may be composed of different materials depending on required characteristics.

The plate 300 forms a part of the sole 10. The plate 300 is higher in rigidity than the midsole 200. The plate 300 is composed of a fiber-reinforced resin or a non-fiber-reinforced resin. Examples of fibers to be used for the fiber-reinforced resin include carbon fibers, glass fibers, aramid fibers, Dyneema® fibers, ZYLON® fibers, and boron fibers. Examples of the non-fiber-reinforced resin include polymer resins such as a polyurethane-based thermoplastic elastomer (TPU) and an amid-based thermoplastic elastomer (TPA).

The plate 300 is provided in the midsole 200. As shown in FIG. 3, in the present embodiment, the plate 300 is arranged within the midsole 200. Specifically, the plate 300 is arranged between the lower midsole 210 and the upper midsole 220. The plate 300 is bonded to at least one of the lower midsole 210 and the upper midsole 220. The midsole 200 includes an accommodation portion that defines a space where the plate 300 is accommodated. The accommodation portion is in a shape conforming to the shape of the plate 300.

The plate 300 includes a mid- and rear-foot support portion 310 and a forefoot support portion 320.

The mid- and rear-foot support portion 310 is a part that supports the midfoot portion and the rear foot portion of the wearer. The mid- and rear-foot support portion 310 is in a shape extending from a position superimposed on a rear end portion B11 of the metatarsal bone B10 of the wearer in the thickness direction to a position superimposed on a rear end portion B21 of a heel bone B20 of the wearer. In the present embodiment, the mid- and rear-foot support portion 310 is in a shape extending from a part of the plate 300 superimposed in the thickness direction on an intermediate portion of the metatarsal bone B10 in the foot length direction to the rear end portion of the plate 300.

Figure 4:
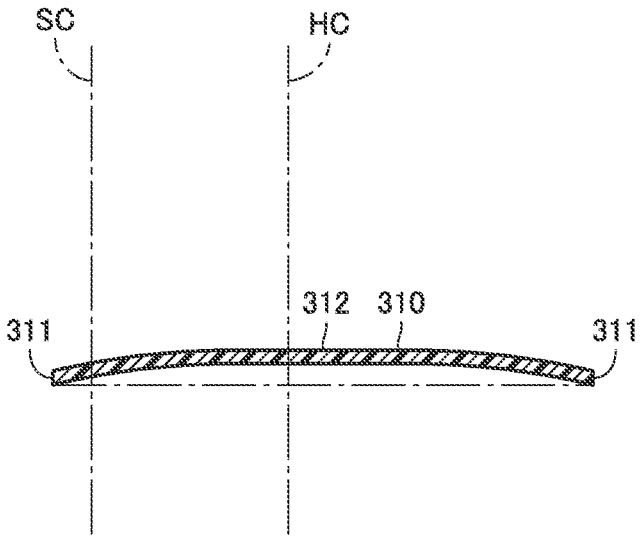
FIG. 4 is a cross-sectional view along the line IV-IV in FIG. 2.
Figure 5:
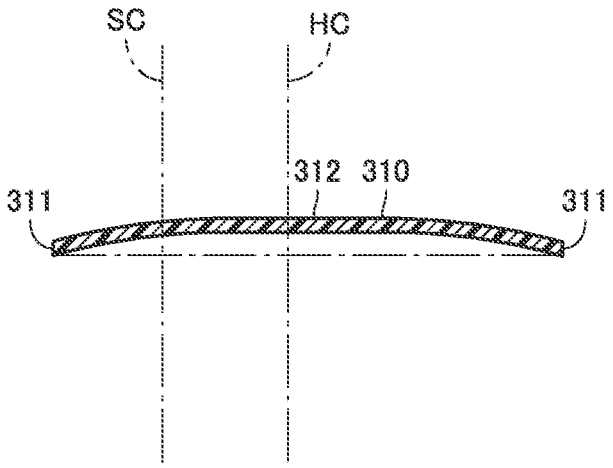
FIG. 5 is a cross-sectional view along the line V-V in FIG. 2.
Figure 6:
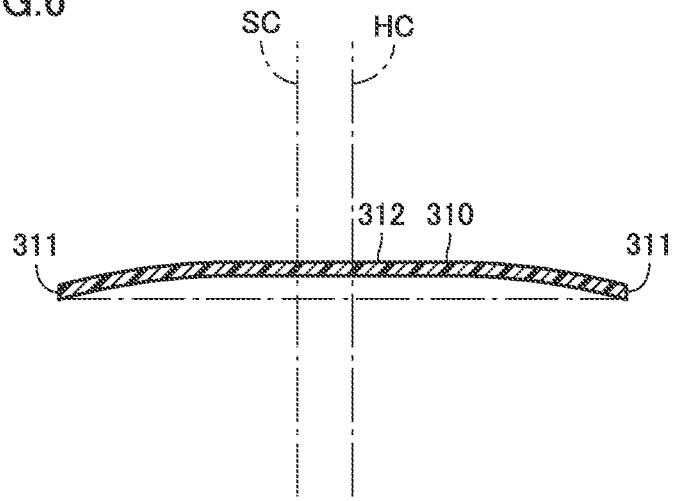
FIG. 6 is a cross-sectional view along the line VI-VI in FIG. 2.

As shown in FIGS. 4 to 6, the mid- and rear-foot support portion 310 is in a shape convex upward (a shape like one large arc that is convex upward as a whole) in the cross-section in the foot width direction. The mid- and rear-foot support portion 310 includes an edge portion 311 formed at an end in the foot width direction. FIG. 3 shows the edge portion 311 with a dashed line.

The mid- and rear-foot support portion 310 includes a top portion 312 located at a position highest in the thickness direction. The top portion 312 is located at a position overlapping with a heel center HC of the wearer in the thickness direction. In the present embodiment, the top portion 312 is formed as being flat. Therefore, contact of the heel portion with the foot at the time of landing is excellent. The top portion 312 may be formed in a shape curved at a curvature smaller than a curvature of a part of the mid- and rear-foot support portion 310 other than the top portion 312 or in a shape curved at a curvature equal to the curvature of the part of the mid- and rear-foot support portion 310 other than the top portion 312 (a shape curved such that the entire region of the mid- and rear-foot support portion 310 in the cross-section in the foot width direction is uniform in curvature). FIG. 2 shows the top portion 312 with hatching and an outer geometry of the top portion 312 with a thin line. The heel center HC means a straight line that connects the center of the heel bone of the standard wearer of the shoe 1 to a position between the third toe and the fourth toe.

FIG. 3 shows a cross-section of the shoe 1 along a half line AB (see FIG. 2) and a half line AC (see FIG. 2). The half line AB is a half line that extends from a rear end portion A of a fourth metatarsal bone toward an intersection B between the heel center HC and the rear end portion of the plate 300. The half line AC is a half line that extends from the rear end portion A toward an intersection C between the front end portion of the plate 300 and the shoe center SC.

For example, in the cross-section (the cross-section shown in FIG. 6) of the mid- and rear-foot support portion 310 in the foot width direction at the position superimposed on the heel portion of the wearer, a length W12 of the top portion 312 in the foot width direction is preferably at least 0.3 times and at most 0.8 times and more preferably at least 0.45 times and at most 0.65 times as long as a length W11 between the edge portions 311 in the foot width direction.

Figure 7:
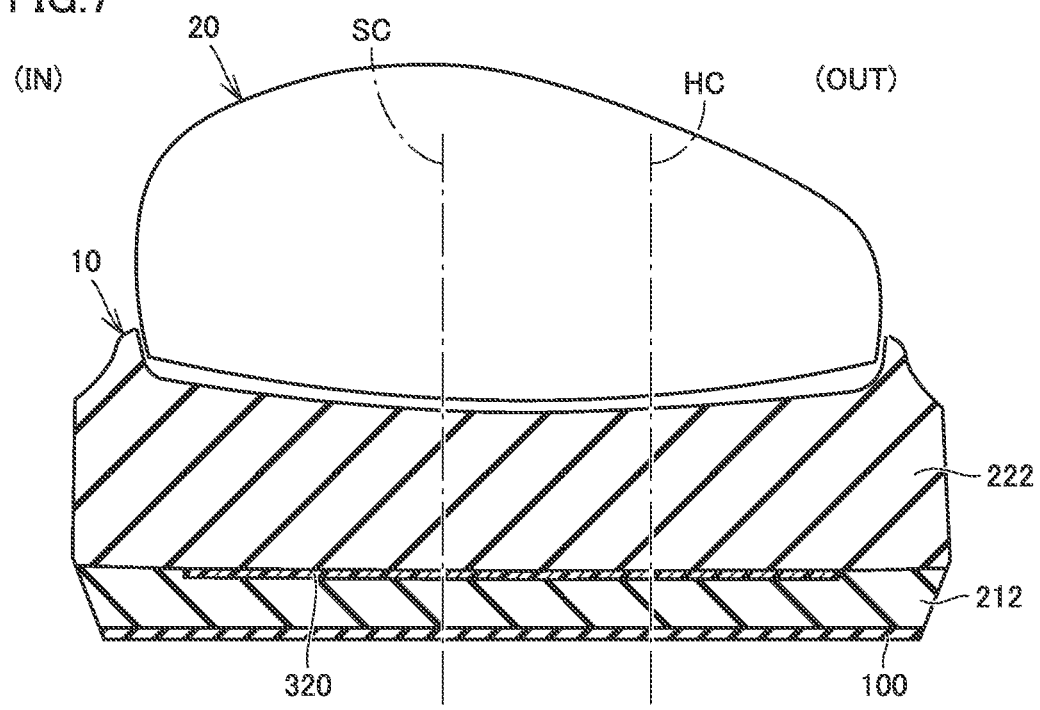
FIG. 7 is a cross-sectional view along the line VII-VII in FIGS. 2 and 3.

The forefoot support portion 320 is a part that supports the forefoot portion of the wearer. The forefoot support portion 320 deforms mainly in the foot length direction at the time of landing or take-off. The forefoot support portion 320 is formed in front of the mid- and rear-foot support portion 310. FIG. 7 shows a cross-section of the shoe 1 in the foot width direction at a position that passes through the forefoot support portion 320. As shown in FIG. 7, the cross-section of the forefoot support portion 320 in the foot width direction is formed as being flat. In the present embodiment, in the entire region of the plate 300 in front of the mid- and rear-foot support portion 310, the cross-section in the foot width direction is formed as being flat. In FIG. 7, "out" means the outer side in the foot width direction and "in" means the inner side in the foot width direction. This is also applicable to other figures.

As shown in FIG. 7, the lower surface of the lower midsole 210 in the foot width direction at the position that passes through the forefoot support portion 320 is formed as being flat.

The plate 300 in the present embodiment described above includes the mid- and rear-foot support portion 310 in the shape convex upward in the cross-section in the foot width direction. Therefore, during a period from landing until take-off, the midfoot portion and the rear foot portion of the wearer are effectively supported. Therefore, sinking down of the arch portion and the heel during the period from landing until take-off is suppressed.

A modification of the embodiment will be described below.

First Modification

Figure 8:
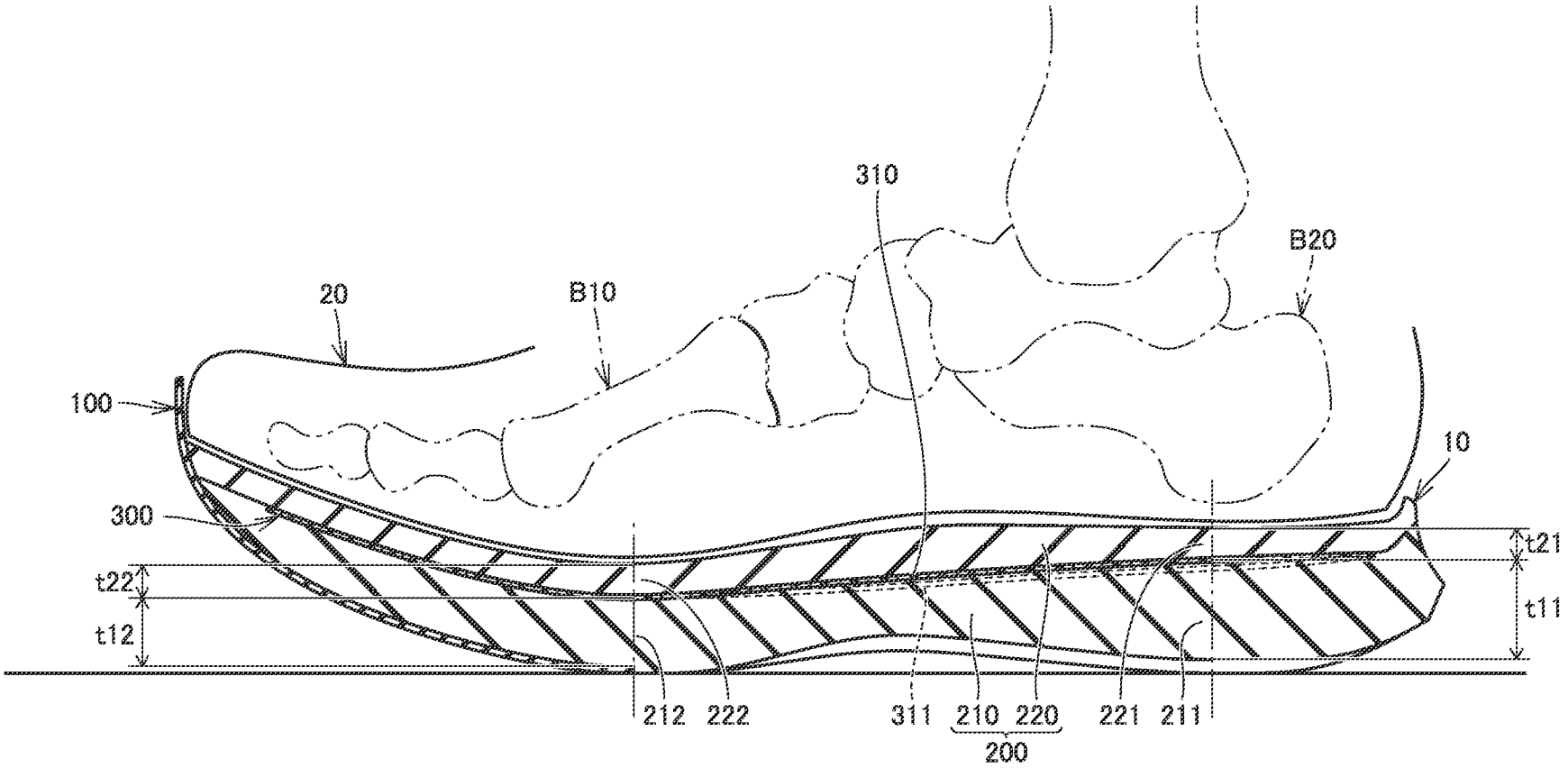
FIGS. 8 and 9 are each a diagram showing a modification of arrangement relation between a midsole and the plate.

As shown in FIG. 8, the thickness t12 of the lower middle region 212 may be larger than the thickness t22 of the upper middle region 222. In this case as well, as in the embodiment, the thickness t11 of the lower heel region 211 is preferably larger than the thickness t21 of the upper heel region 221.

Second Modification

Figure 9:
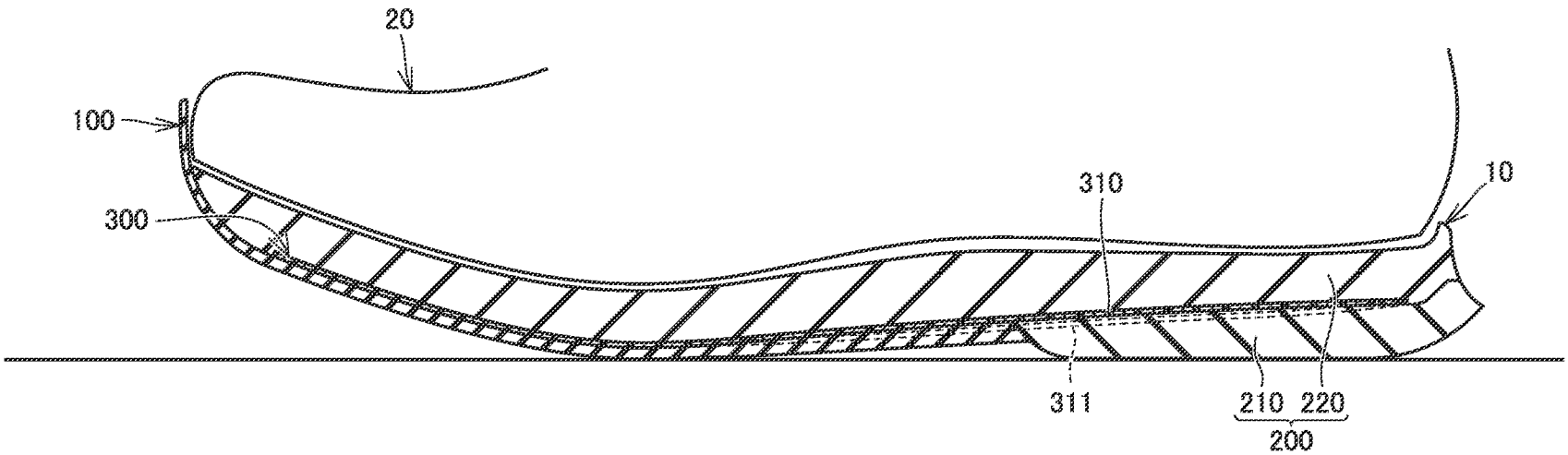

As shown in FIG. 9, the front portion of the plate 300 may be arranged between the lower surface of the midsole 200 and the outer sole 100. In this aspect, stability in the forefoot portion is enhanced.

Third Modification

Figure 10:
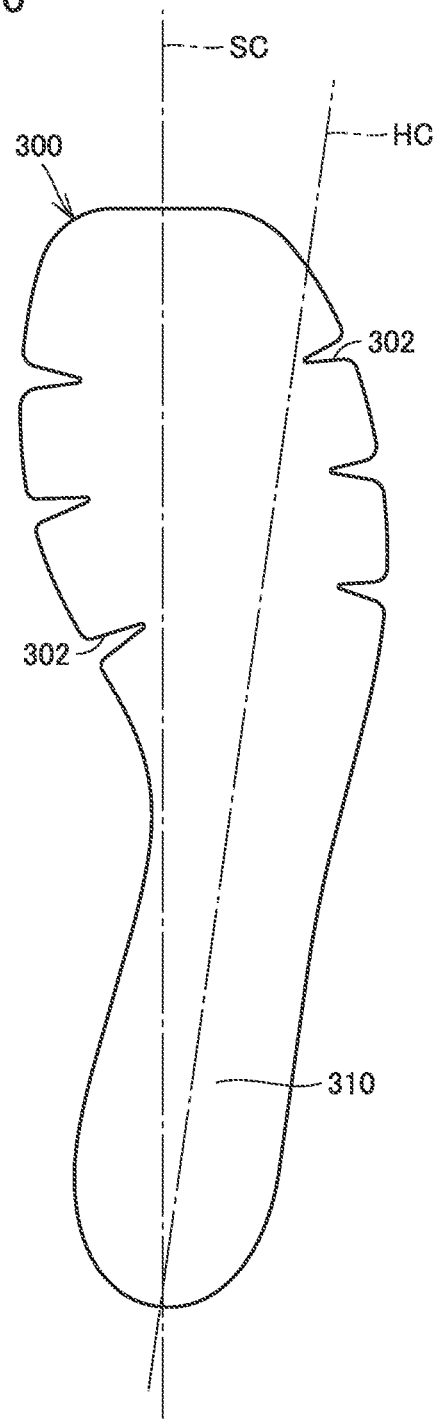
FIGS. 10 to 12 are each a plan view showing a modification of the plate.

As shown in FIG. 10, a cut 302 may be provided in the edge portion in the front portion of the plate 300. In the example shown in FIG. 10, a plurality of cuts 302 are provided in the front portion of the plate 300, as being aligned at intervals in the foot length direction in both of the edge portion on the outer side and the edge portion on the inner side in the foot width direction. In this aspect, since the plate 300 more readily deforms, shock absorbing performance is enhanced.

Fourth Modification

Figure 11:
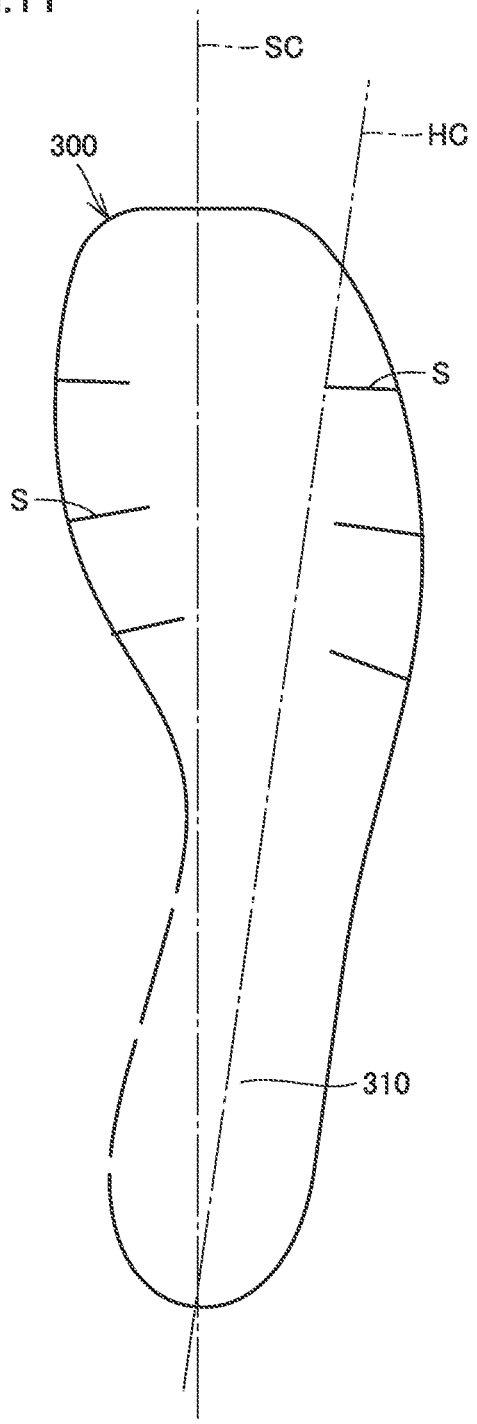

As shown in FIG. 11, a plurality of slits S may be provided in the front portion of the plate 300, as being aligned at intervals in the foot length direction in both of the edge portion on the outer side and the edge portion on the inner side in the foot width direction.

Fifth Modification

Figure 12:
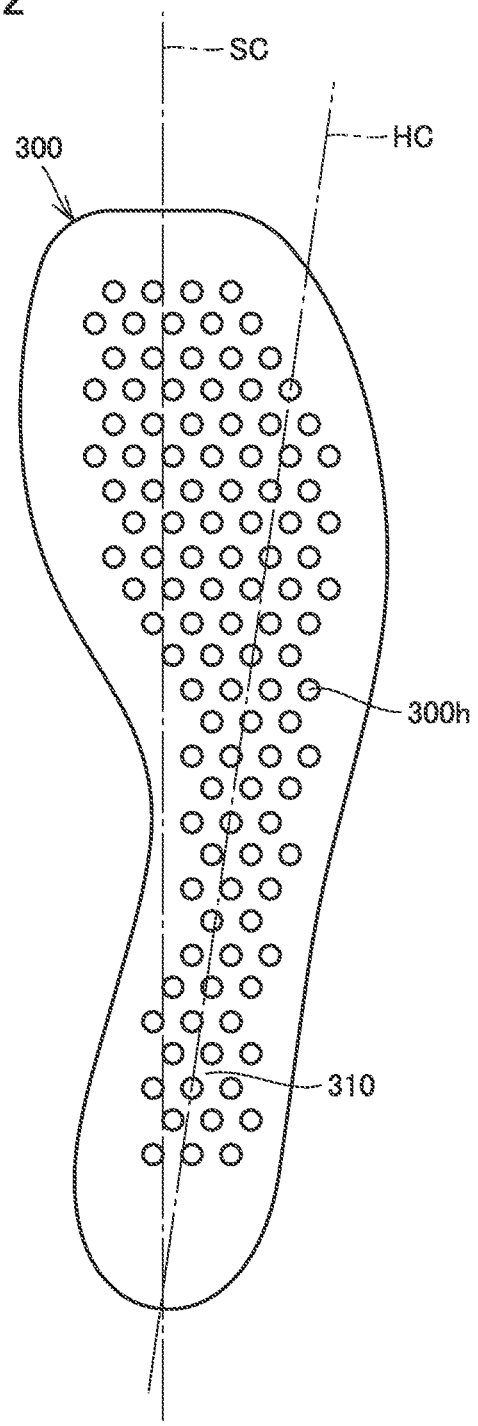
Figure 13:
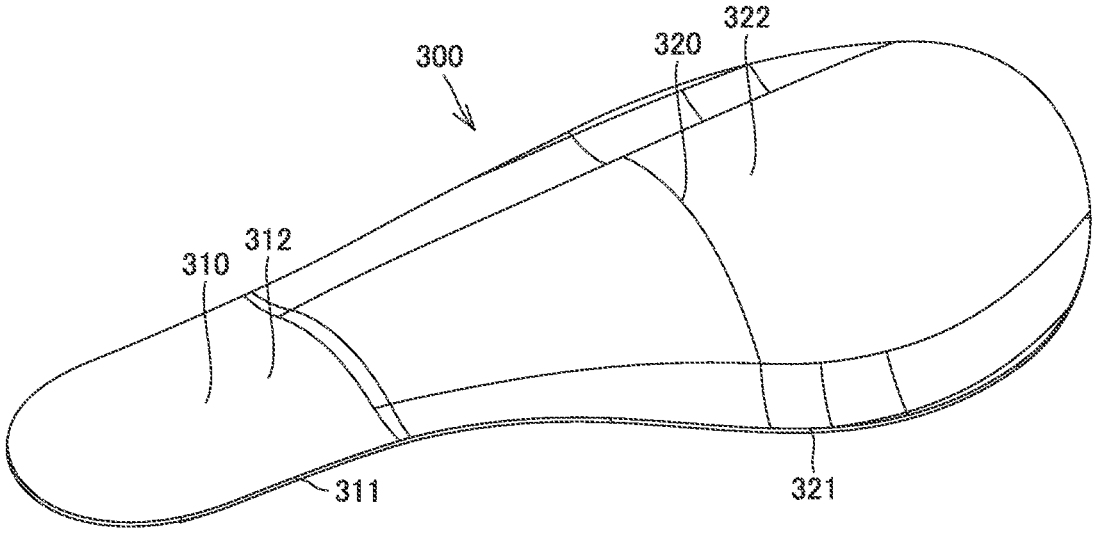
FIG. 13 is a perspective view of a plate used in a shoe in a second embodiment of the present disclosure.

As shown in FIG. 12, through holes **300*h* may be provided in the plate 300. In this aspect, the plate 300 is reduced in weight while rigidity of the plate 300** is maintained.

Second Embodiment

The shoe 1 in a second embodiment of the present disclosure will now be described with reference to FIGS. 13 to 20. In the second embodiment, only differences from the first embodiment will be described, and description of a structure, functions, and effects the same as those in the first embodiment will not be repeated.

Figure 16:
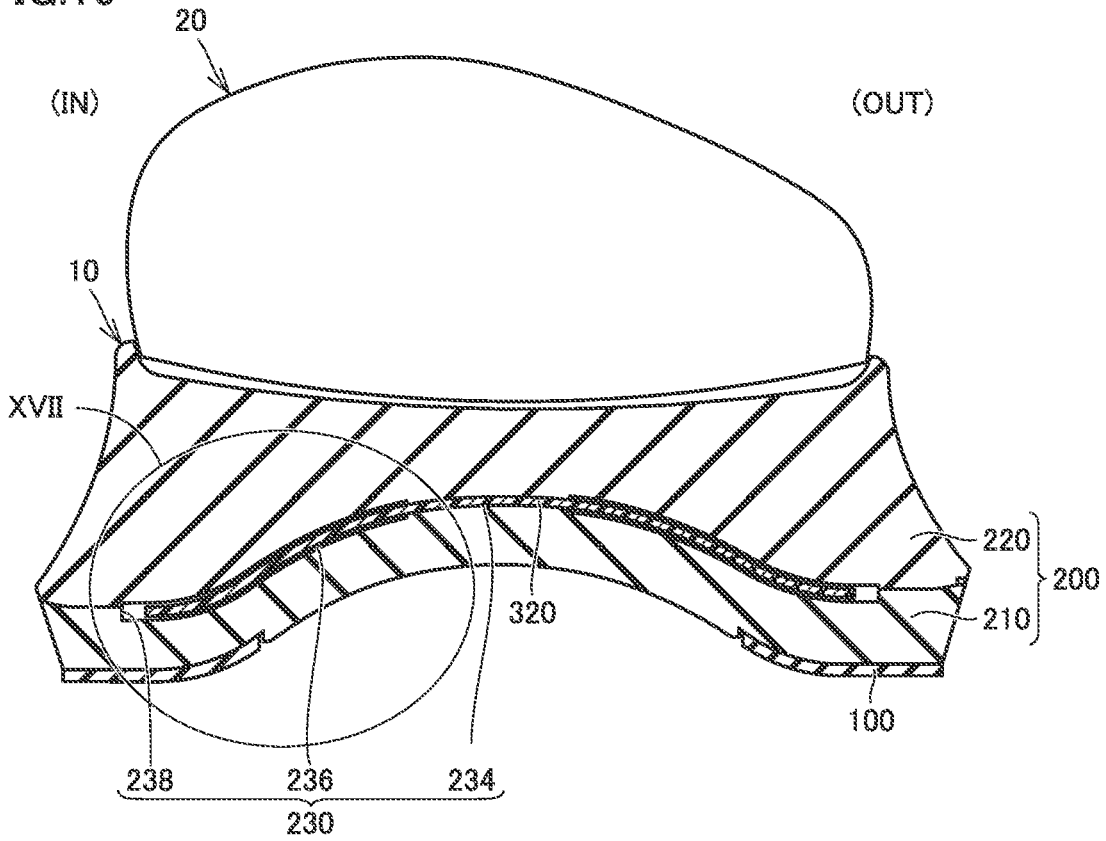
FIG. 16 is a cross-sectional view along the line XVI-XVI in FIG. 15.

In the present embodiment, the forefoot support portion 320 is in a shape convex upward in the cross-section in the foot width direction. As shown in FIG. 16, the forefoot support portion 320 is in a shape curved convexly upward. In the present embodiment, the top portion 312 of the mid- and rear-foot support portion 310 is also in a shape curved convexly upward. The mid- and rear-foot support portion 310 and the forefoot support portion 320 are in a shape curved convexly upward and continuous in the foot length direction. In this aspect, a degree of deformation at a boundary between the mid- and rear-foot support portion 310 and the forefoot support portion 320 is suppressed. The top portion 312 may be formed as being flat as in the first embodiment.

Figure 14:
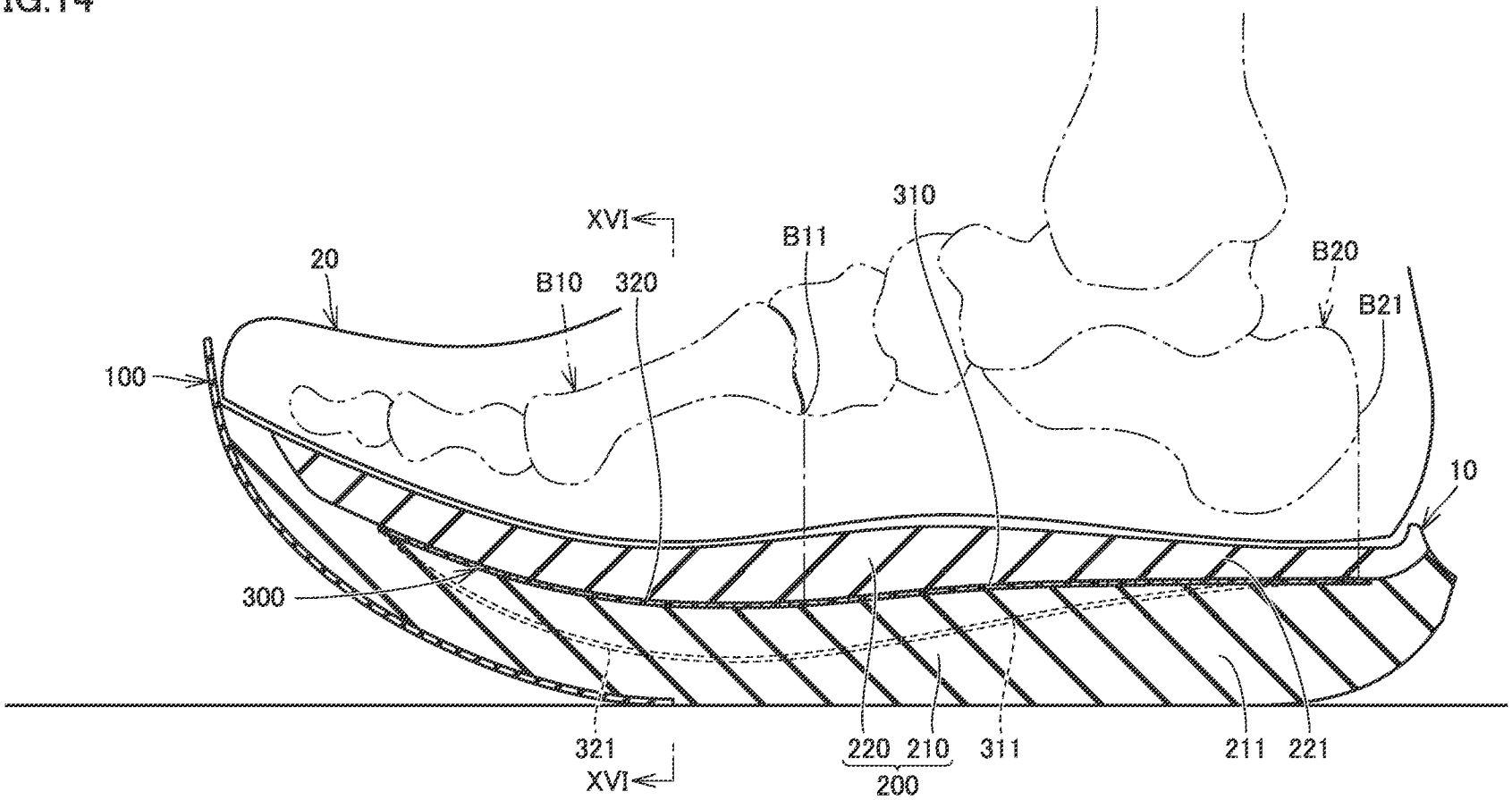
FIG. 14 is a cross-sectional view of the shoe in the second embodiment at a position the same as the line shown in FIG. 2.

FIG. 14 shows with a dashed line, the edge portion 311 of the mid- and rear-foot support portion 310 and an edge portion 321 of the forefoot support portion 320 in the foot width direction.

As shown in FIG. 16, a part of the lower midsole 210 located below the forefoot support portion 320 is in a shape curved convexly upward. Thus, the part of the lower midsole 210 below the forefoot support portion 320 more readily deforms. Therefore, the forefoot support portion 320 of the plate 300 also more readily deforms. The shape of the part of the lower midsole 210 located below the forefoot support portion 320 is not limited as above, but may be formed, for example, as being flat.

Figure 19:
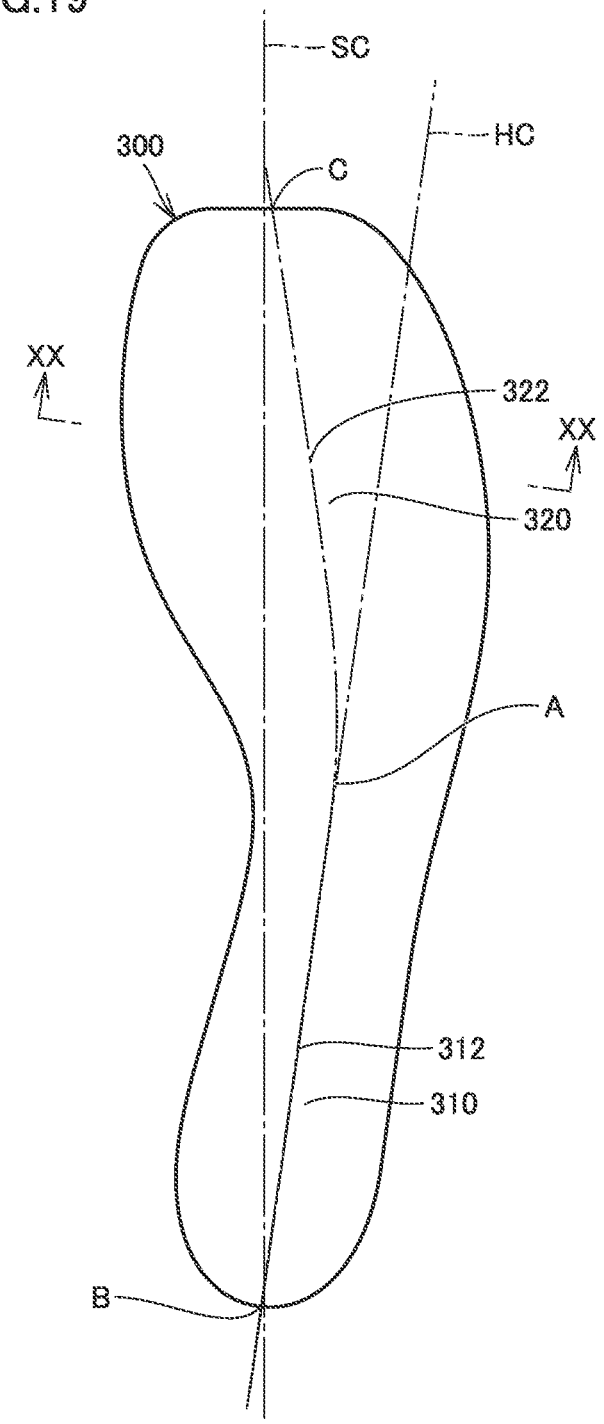
FIG. 19 is a plan view showing positions of a top portion and a peak portion.
Figure 20:
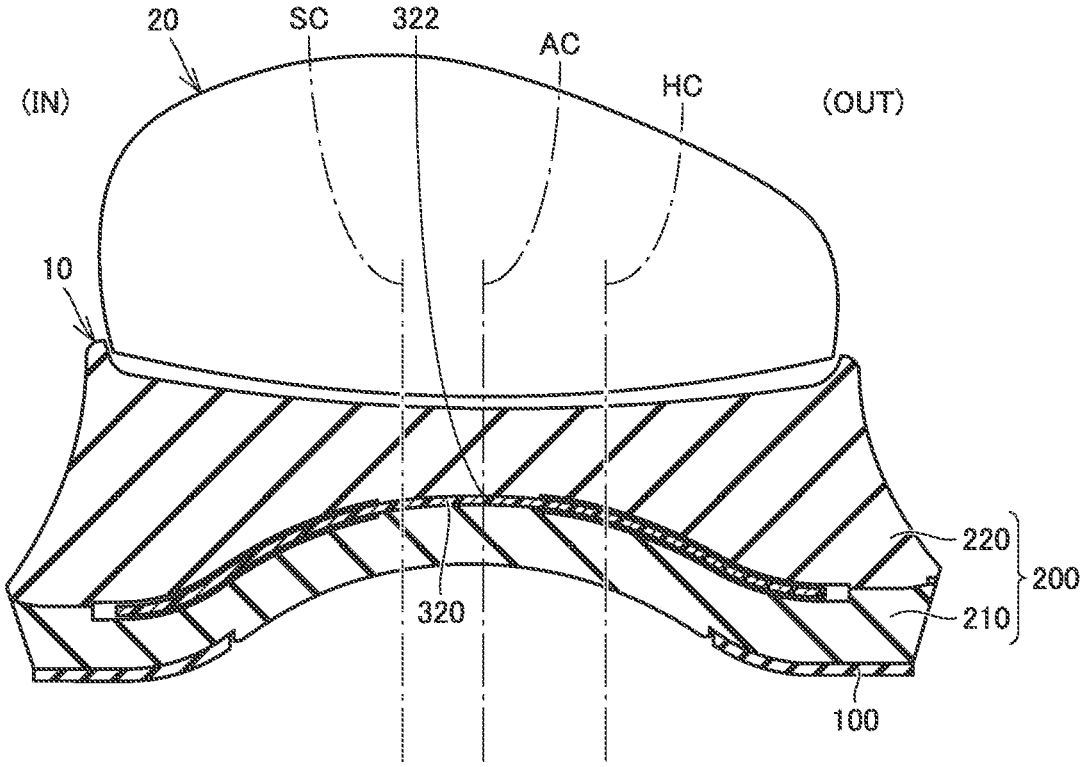
FIG. 20 is a cross-sectional view along the line XX-XX in FIG. 19.

The forefoot support portion 320 includes a peak portion 322. As shown in FIGS. 19 and 20, the peak portion 322 is located on the half line AC.

As shown in FIG. 16, an accommodation portion 230 of the midsole 200 includes a contact portion 234, a recess portion 236, and an opposing portion 238.

Figure 17:
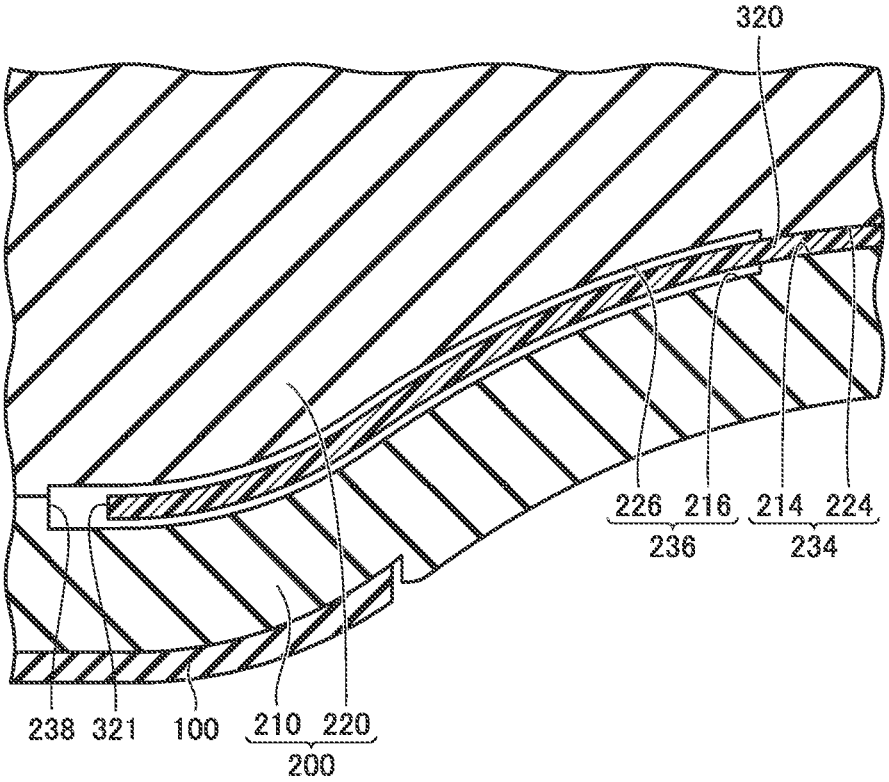
FIG. 17 is an enlarged view of an area surrounded by a solid line shown with XVII in FIG. 16.

The contact portion 234 is a part in contact with the forefoot support portion 320. The contact portion 234 is bonded to the forefoot support portion 320 with a bonding member (not shown) being interposed. In other words, the contact portion 234 implements the "bonded portion" bonded to the forefoot support portion 320. As shown in FIG. 17, the contact portion 234 includes a lower contact portion 214 and an upper contact portion 224. The lower contact portion 214 is formed in a front portion in the foot length direction and in a central portion in the foot width direction, of the lower midsole 210. The lower contact portion 214 is in a shape extending in the foot length direction.

The upper contact portion 224 is formed directly above the lower contact portion 214. The upper contact portion 224 is in a shape extending in the foot length direction.

The recess portion 236 is in a shape recessed from the contact portion 234 in a direction away from the forefoot support portion 320 in the thickness direction. The recess portion 236 is provided at a position adjacent to the contact portion 234 in the foot width direction. The recess portion 236 is not bonded to the forefoot support portion 320. In other words, the recess portion 236 implements the "non-bonded portion." The recess portion 236 includes a lower recess portion 216 and an upper recess portion 226.

The lower recess portion 216 is provided at a position in the lower midsole 210, adjacent to the lower contact portion 214 in the foot width direction. As shown in FIG. 17, the lower recess portion 216 is in a shape recessed downward from the lower contact portion 214. The lower recess portion 216 extends to the outer side in the foot width direction, relative to the edge portion 321 of the forefoot support portion 320.

The upper recess portion 226 is provided at a position in the upper midsole 220, opposed to the lower recess portion 216 in the thickness direction. As shown in FIG. 17, the upper recess portion 226 is in a shape recessed upward from the upper contact portion 224. The upper recess portion 226 extends to the outer side in the foot width direction, relative to the edge portion 321 of the forefoot support portion 320.

Figure 15:
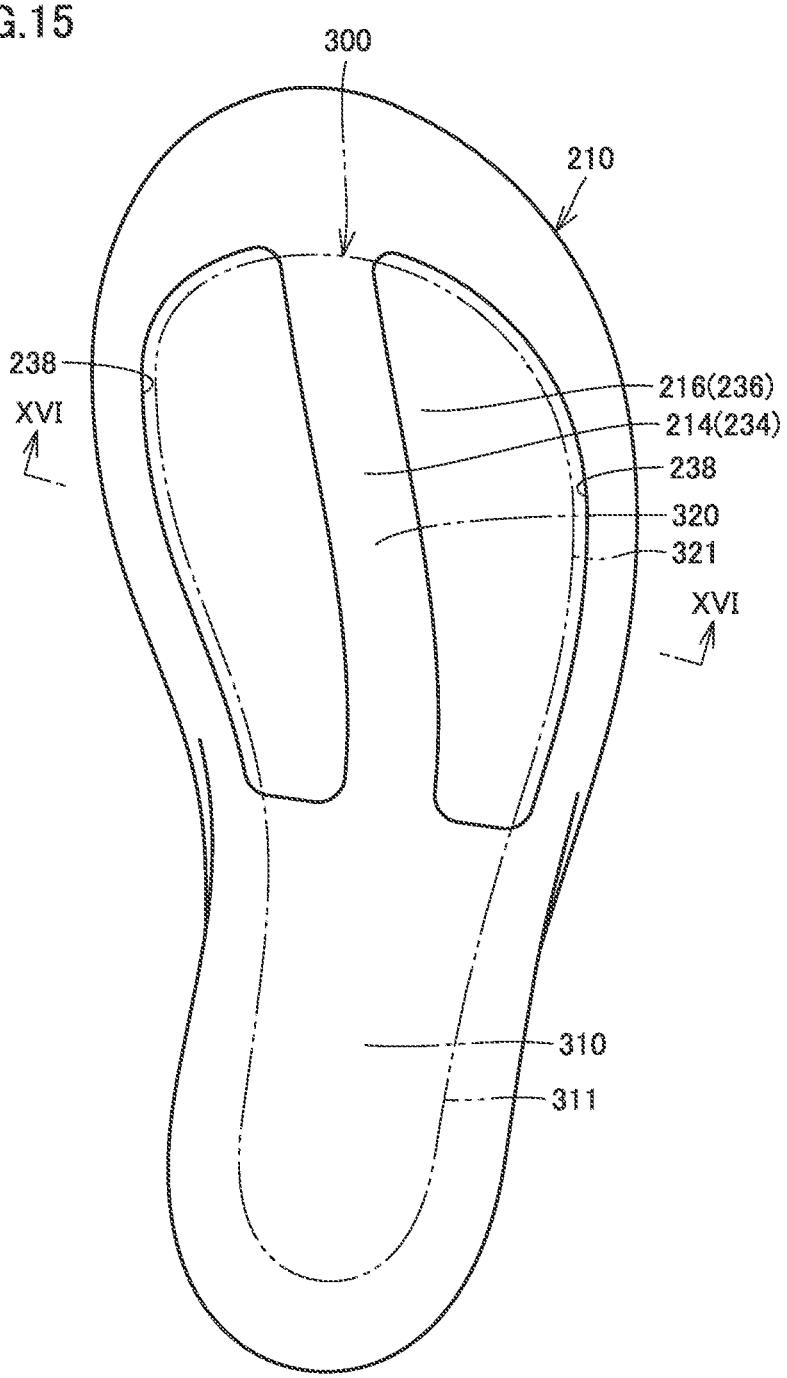
FIG. 15 is a plan view showing relation between a lower midsole and the plate.

The opposing portion 238 is a part opposed to the forefoot support portion 320 in the foot width direction. The opposing portion 238 is opposed to the edge portion 321 of the forefoot support portion 320. As shown in FIGS. 15 to 17, the opposing portion 238 is distant from the edge portion 321 of the forefoot support portion 320 in the foot width direction while a load is not applied to the forefoot support portion 320. The opposing portion 238 couples an end on the outer side of the lower recess portion 216 in the foot width direction and an end on the outer side of the upper recess portion 226 in the foot width direction to each other.

Figure 18:
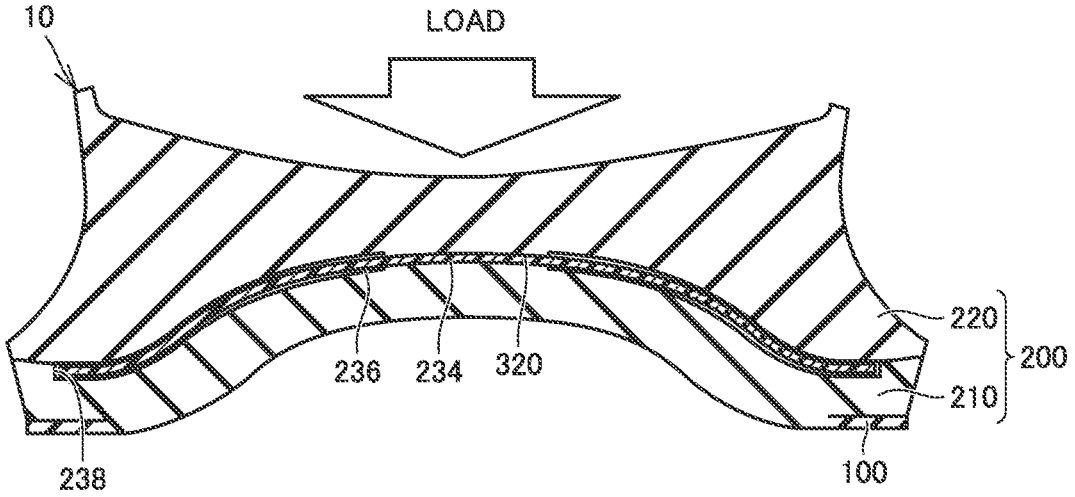
FIG. 18 is a cross-sectional view showing relation between the midsole and a forefoot support portion when a load is applied.

As shown in FIG. 18, when a load is applied to the forefoot support portion 320, the forefoot support portion 320 deforms to spread outward in the foot width direction. In the present embodiment, while a load is not applied to the sole 10, a gap is provided between the forefoot support portion 320 and the opposing portion 238, and therefore, interference with deformation of the forefoot support portion 320 in the foot width direction at the time of application of the load to the forefoot support portion 320 is suppressed.

In the present embodiment, since deformation of the forefoot support portion 320 is applied to the forefoot portion at the time of take-off, stable shock absorbing performance is expected.

A modification of the second embodiment will be described below.

Sixth Modification

Figure 21:
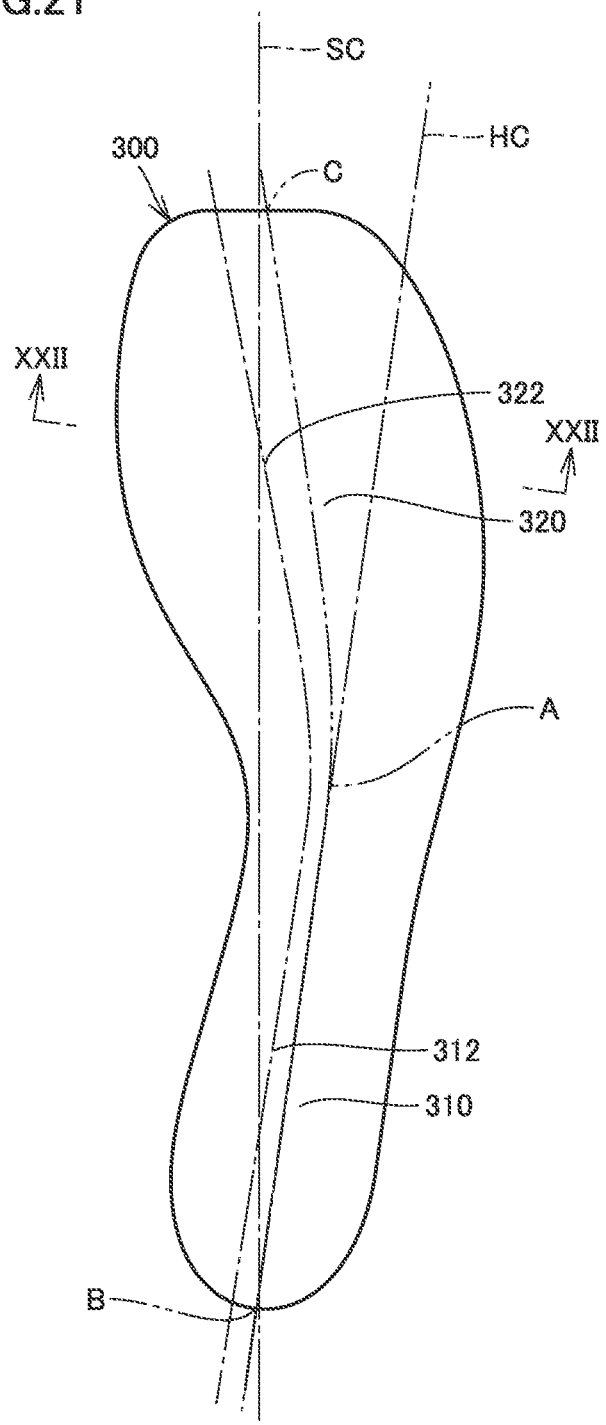
FIG. 21 is a plan view showing a modification of the positions of the top portion and the peak portion.
Figure 22:
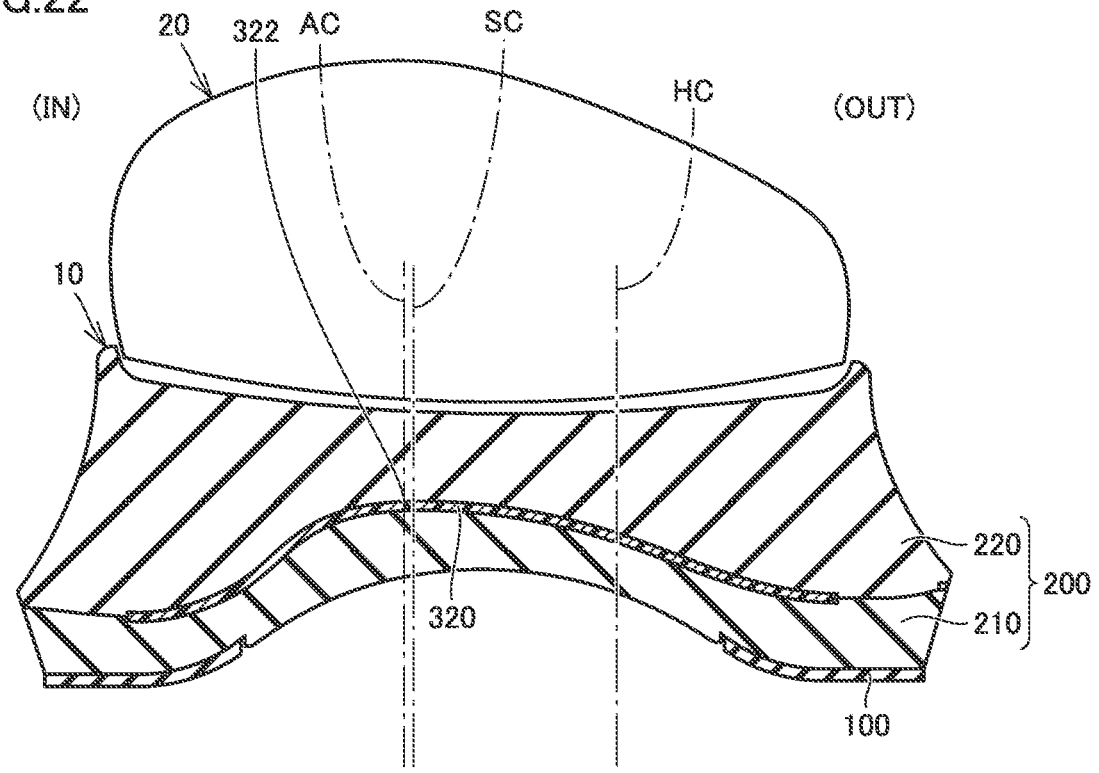
FIG. 22 is a cross-sectional view along the line XXII-XXII in FIG. 21.

As shown in FIGS. 21 and 22, the peak portion 322 may be located on the inner side in the foot width direction relative to the position on the half line AC.

The top portion 312 may be located on the inner side in the foot width direction relative to the half line AB. This is also applicable to the first embodiment.

FIG. 21 shows with a chain double dotted line, the half line AB and the half line AC shown at the positions the same as in FIG. 19.

Seventh Modification

Figure 23:
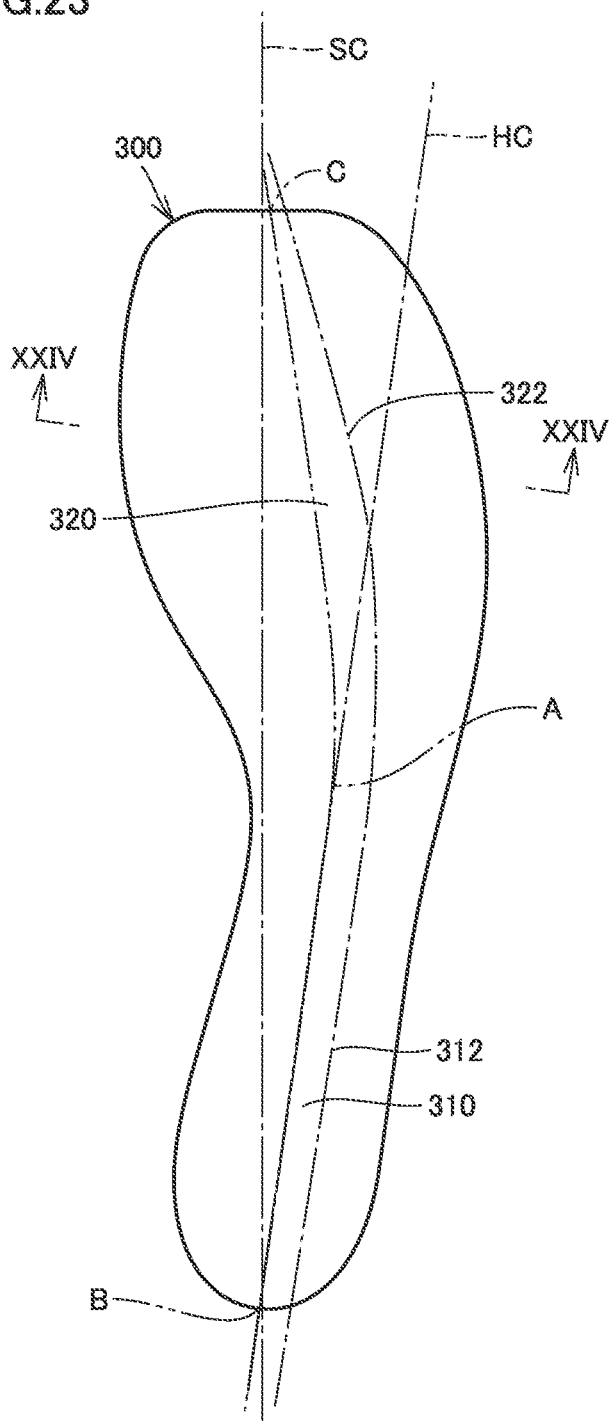
FIG. 23 is a plan view showing a modification of the positions of the top portion and the peak portion.
Figure 24:
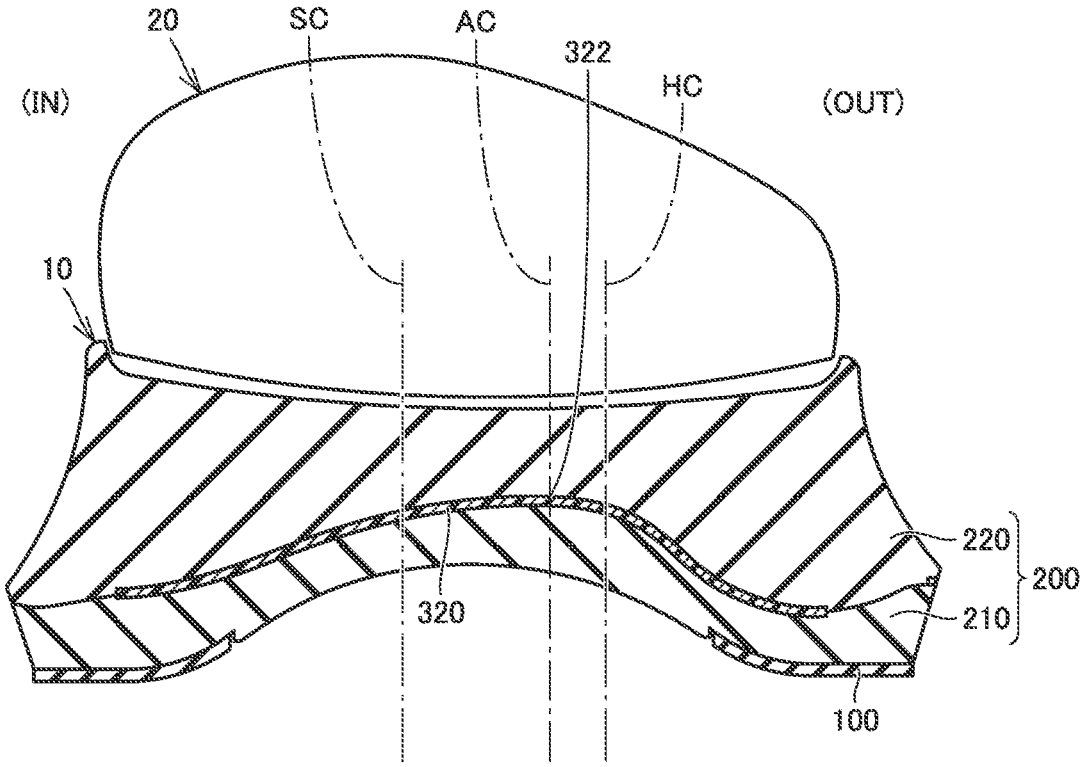
FIG. 24 is a cross-sectional view along the line XXIV-XXIV in FIG. 23.

As shown in FIGS. 23 and 24, the peak portion 322 may be located on the outer side in the foot width direction relative to the position on the half line AC.

The top portion 312 may be located on the outer side in the foot width direction relative to the half line AB. This is also applicable to the first embodiment.

FIG. 23 shows with a chain double dotted line, the half line AB and the half line AC shown at the positions the same as in FIG. 19.

Eighth Modification

Figure 25:
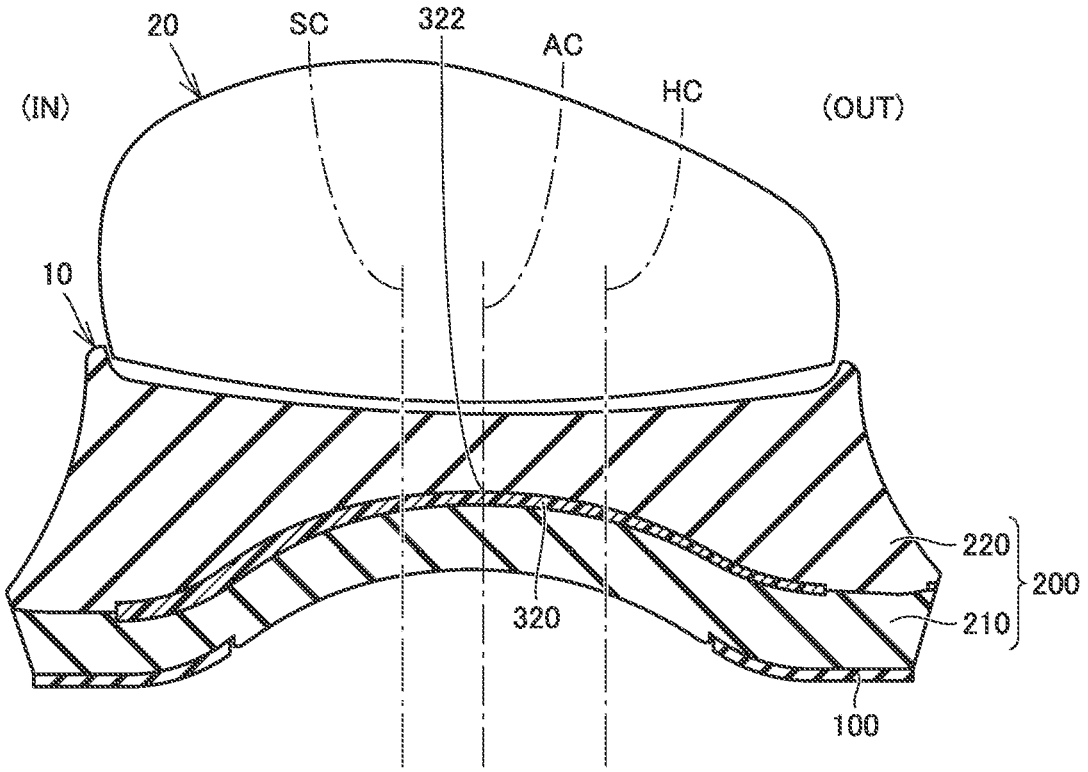
FIGS. 25 and 26 are each a cross-sectional view showing a modification of the forefoot support portion.

As shown in FIG. 25, the peak portion 322 is located on the half line AC and a part of the forefoot support portion 320 on the outer side of the peak portion 322 in the foot width direction may be smaller in thickness than a part on the inner side of the peak portion 322. In this aspect as well, an effect as in the sixth modification is obtained. In this case, preferably, the part of the forefoot support portion 320 on the outer side of the peak portion 322 in the foot width direction is formed to gradually decrease in thickness toward the outer side in the foot width direction, and the part of the forefoot support portion 320 on the inner side of the peak portion 322 in the foot width direction is formed to gradually increase in thickness toward the inner side in the foot width direction.

When the shape of the forefoot support portion 320 is formed as in the second embodiment and the part of the forefoot support portion 320 on the outer side of the peak portion 322 is formed of a material lower in rigidity than the part on the inner side of the peak portion 322 as well, an effect as in the sixth modification is obtained.

Ninth Modification

Figure 26:
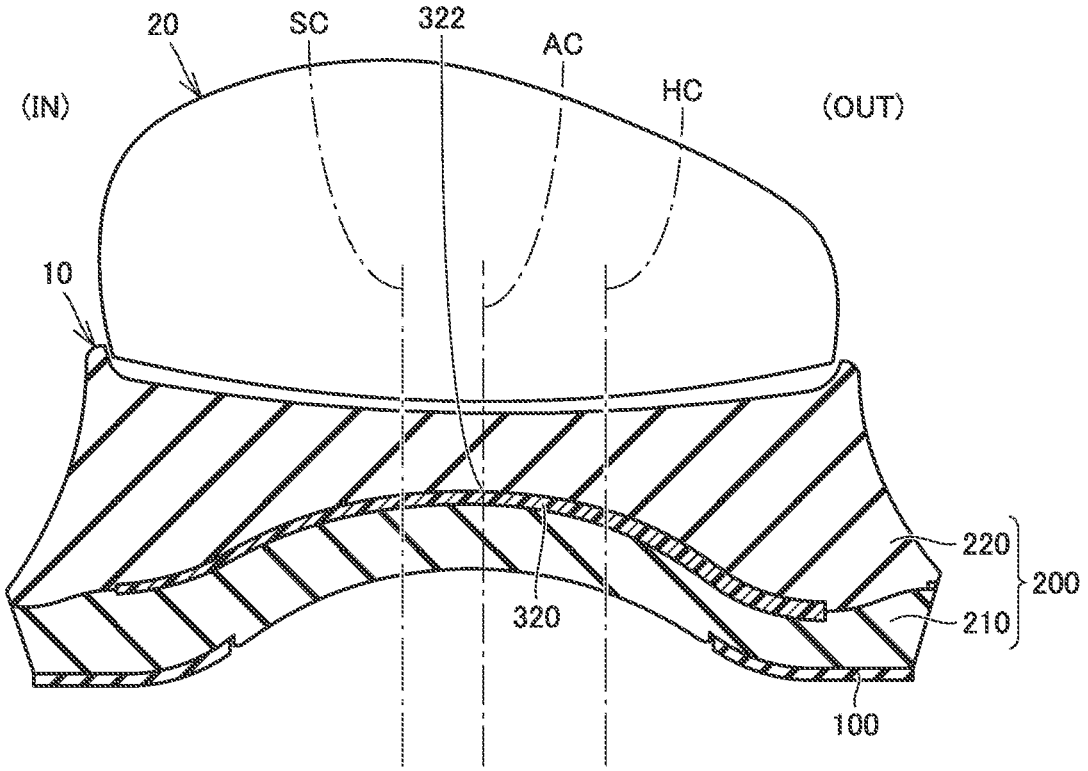

As shown in FIG. 26, the peak portion 322 may be located on the half line AC, and the part of the forefoot support portion 320 on the outer side of the peak portion 322 in the foot width direction may be formed as being larger in thickness than the part on the inner side of the peak portion 322. In this aspect as well, an effect as in the seventh modification is obtained. In this case, preferably, the part of the forefoot support portion 320 on the outer side of the peak portion 322 in the foot width direction is formed to gradually increase in thickness toward the outer side in the foot width direction, and the part of the forefoot support portion 320 on the inner side of the peak portion 322 in the foot width direction is formed to gradually decrease in thickness toward the inner side in the foot width direction.

When the shape of the forefoot support portion 320 is formed as in the second embodiment and the part of the forefoot support portion 320 on the inner side of the peak portion 322 is formed of a material lower in rigidity than the part on the outer side of the peak portion 322 as well, an effect as in the seventh modification is obtained.

Tenth Modification

Though an example in which both of the lower contact portion 214 and the upper contact portion 224 are bonded to the forefoot support portion 320 is described in the second embodiment, the forefoot support portion 320 should only be bonded to at least one of the lower midsole 210 and the upper midsole 220. For example, when the lower midsole 210 is lower in rigidity than the upper midsole 220, at the time of application of a load to the sole 10, the lower midsole 210 is larger in amount of deformation than the upper midsole 220. Therefore, an upper surface of the forefoot support portion 320 may be bonded to the upper contact portion 224, and the lower surface of the forefoot support portion 320 does not have to be bonded to the lower contact portion 214.

The recess portion 236 does not have to be provided, the entire lower surface of the forefoot support portion 320 may be in contact with the lower midsole 210, and the entire upper surface of the forefoot support portion 320 may be in contact with the upper midsole 220. In this case as well, when the lower midsole 210 is lower in rigidity than the upper midsole 220 as above, only the upper surface of the forefoot support portion 320 may be bonded to the upper midsole 220 and the lower surface of the forefoot support portion 320 does not have to be bonded to the lower midsole 210.

It should be understood that the embodiments disclosed herein are illustrative and non-restrictive in every respect. The scope of the present invention is defined by the terms of the claims rather than the description of the embodiments above and is intended to include any modifications within the scope and meaning equivalent to the terms of the claims.

Aspects

Illustrative embodiments described above are understood by a person skilled in the art as specific examples of aspects below.

A plate according to one aspect of this disclosure is a plate used for a sole that forms a part of a shoe, and the plate includes a mid- and rear-foot support portion in a shape extending from a position superimposed on a rear end portion of a metatarsal bone of a wearer of the shoe in a thickness direction of the sole to a position superimposed on a heel bone of the wearer, the mid- and rear-foot support portion supporting a midfoot portion and a rear foot portion of the wearer. The mid- and rear-foot support portion is in a shape convex upward in a cross-section in a foot width direction.

This plate includes the mid- and rear-foot support portion in the shape convex upward in the cross-section in the foot width direction. Therefore, during a period from landing until take-off, the midfoot portion and the rear foot portion of the wearer are effectively supported. Therefore, sinking down of the arch portion and the heel during the period from landing until take-off is suppressed.

Preferably, the mid- and rear-foot support portion includes a top portion located at a position highest in the thickness direction.

In this case, the top portion may be located at a position overlapping with a heel center of the wearer in the thickness direction.

In this aspect, when a load is applied vertically downward from the midfoot portion and the rear foot portion to the mid- and rear-foot support portion, the mid- and rear-foot support portion substantially evenly deforms in the foot width direction. Therefore, when the load is removed, vertically upward resilience is produced in the midfoot portion and the rear foot portion. The heel center means a straight line that connects the center of the heel bone of a standard wearer of the shoe 1 to a position between the third toe and the fourth toe.

Alternatively, the top portion may be located on an inner side in the foot width direction relative to a heel center of the wearer.

In this aspect, the part of the mid- and rear-foot support portion relatively lower in flexural rigidity is located on the outer side in the foot width direction, and the part of the mid- and rear-foot support portion relatively higher in flexural rigidity is located on the inner side in a width direction. Therefore, when a load is applied to the part of the mid- and rear-foot support portion on the outer side of the heel center at the time of landing, deformation of the mid- and rear-foot support portion is promoted and shock absorbing performance is enhanced. Furthermore, since flexural rigidity of the part of the mid- and rear-foot support portion on the inner side of the heel center is enhanced, occurrence of pronation at the time of landing is suppressed.

Alternatively, the top portion may be located on an outer side in the foot width direction relative to a heel center of the wearer.

In this aspect, the part of the mid- and rear-foot support portion relatively higher in flexural rigidity is located on the outer side in the foot width direction, and the part of the mid- and rear-foot support portion relatively lower in flexural rigidity is located on the inner side in a width direction. Therefore, stability at the time when a load is applied to the part of the mid- and rear-foot support portion on the outer side of the heel center at the time of landing is enhanced.

Preferably, the plate further includes a forefoot support portion that is in a shape extending forward from the mid- and rear-foot support portion and supports a forefoot portion of the wearer, and the forefoot support portion is in a shape convex upward in a cross-section in a foot width direction.

Thus, since deformation of the forefoot support portion is applied to the forefoot portion at the time of take-off, stable shock absorbing performance is expected.

The forefoot support portion preferably includes a peak portion.

In this case, the peak portion may be located on a straight line that connects an intersection between a front end portion of the forefoot support portion and a shoe center to a front end portion of the mid- and rear-foot support portion.

In this aspect, at the time of take-off, reaction force is applied from the forefoot support portion to substantially the central portion of the forefoot portion in the foot width direction. The shoe center means a centerline of the sole or a straight line that connects the center of the heel bone of a standard wearer of the shoe to a position between the first toe and the second toe.

Alternatively, the peak portion may be located on an inner side in the foot width direction relative to a straight line that connects an intersection between a front end portion of the forefoot support portion and a shoe center to a front end portion of the mid- and rear-foot support portion.

Alternatively, the peak portion may be located on an outer side in the foot width direction relative to a straight line that connects an intersection between a front end portion of the forefoot support portion and a shoe center to a front end portion of the mid- and rear-foot support portion.

A sole according to one aspect of this disclosure includes the plate and a midsole that forms a part of the sole. The midsole includes a lower midsole and an upper midsole connected on the lower midsole. The mid- and rear-foot support portion is arranged between the lower midsole and the upper midsole. The lower midsole includes a lower heel region superimposed on a heel portion of the wearer in the thickness direction. The upper midsole includes an upper heel region superimposed on the heel portion of the wearer in the thickness direction. A thickness of the lower heel region is larger than a thickness of the upper heel region.

In this sole, when input of a load is provided from the heel to the midsole, input of the load is provided directly from the heel to the upper heel region and the load is transmitted to the lower heel region through the mid- and rear-foot support portion. In other words, a high pressure is applied from a part of the heel relatively small in area to the upper heel region, and a low pressure is applied from the mid- and rear-foot support portion larger in area than the part of the heel to the lower heel region. Therefore, since the lower heel region is larger in thickness than the upper heel region, sinking down of the rear foot portion during the period from landing until take-off is effectively suppressed.

A sole according to another aspect of this disclosure includes the plate and a midsole that forms a part of the sole. The midsole includes an accommodation portion that defines a space where the plate is accommodated.

In this case, the accommodation portion may include a bonded portion bonded to the forefoot support portion and a non-bonded portion formed at a position adjacent to the bonded portion in a foot width direction and not bonded to the forefoot support portion.

In this aspect, since the bonded portion is bonded to the forefoot support portion, relative movement of the plate within the accommodation portion is suppressed. Since the non-bonded portion is not bonded to the forefoot support portion, interference with deformation of the forefoot support portion in the foot width direction at the time of application of a load to the forefoot support portion is suppressed.

Preferably, the accommodation portion includes an opposing portion opposed to the forefoot support portion in the foot width direction, and the opposing portion is distant from the forefoot support portion in the foot width direction while a load is not applied to the forefoot support portion.

Thus, interference with deformation of the forefoot support portion in the foot width direction at the time of application of a load to the forefoot support portion is suppressed.

The accommodation portion may include a contact portion in contact with the forefoot support portion and a recess portion in a shape recessed from the contact portion in a direction away from the forefoot support portion in the thickness direction.

Thus, interference with deformation of the forefoot support portion in the foot width direction at the time of application of a load to the forefoot support portion is suppressed.

A shoe according to one aspect of this disclosure includes the sole and an upper connected to the sole and located above the sole.

Though embodiments of the present invention have been described, it should be understood that the embodiments disclosed herein are illustrative and non-restrictive in every respect. The scope of the present invention is defined by the terms of the claims and is intended to include any modifications within the scope and meaning equivalent to the terms of the claims.

What is claimed is:

1. A sole that forms a part of a shoe, comprising:

a plate including a mid- and rear-foot support portion in a shape extending from a position configured to be superimposed on a rear end portion of a metatarsal bone of a wearer of the shoe in a thickness direction of the sole to a position configured to be superimposed on a heel bone of the wearer, the mid- and rear-foot support portion configured to support a midfoot portion and a rear foot portion of the wearer;

the plate further including a forefoot support portion extending forward from the mid- and rear-foot support portion and configured to support a forefoot portion of the wearer, wherein the forefoot support portion includes a shape convex downward in a cross-section along a foot length direction; and a midsole including a lower midsole and an upper midsole connected to the lower midsole, the entire forefoot support portion and the mid-and rear-foot support portion positioned between the lower midsole and the upper midsole;

wherein the mid- and rear-foot support portion is in a shape convex upward in a cross-section along an entire width of the plate in a foot width direction at the position configured to be superimposed on the heel bone of the wearer; and wherein the upper midsole has a greater width than the mid- and rear-foot support portion of the plate in the foot width direction.

2. The sole according to claim 1, wherein:

the mid- and rear-foot support portion includes a top portion located at a position highest in the thickness direction, and the top portion is located at a position configured to overlap with a heel center of the wearer in the thickness direction.

3. The sole according to claim 1, wherein:

the mid- and rear-foot support portion includes a top portion located at a position highest in the thickness direction, and the top portion is located on an inner side in the foot width direction relative to a heel center of the wearer.

4. The sole according to claim 1, wherein:

the mid-and rear-foot support portion includes a top portion located at a position highest in the thickness direction; and the top portion is located on an outer side in the foot width direction relative to a heel center of the wearer.

5. The sole according to claim 1, wherein the forefoot support portion is in a shape convex upward in a cross-section in the foot width direction.

6. The sole according to claim 5, wherein:

the forefoot support portion includes a peak portion; and the peak portion is located on a straight line that connects an intersection between a front end portion of the forefoot support portion and a shoe center to a front end portion of the mid- and rear-foot support portion.

7. The sole according to claim 5, wherein:

the forefoot support portion includes a peak portion; and the peak portion is located on an inner side in the foot width direction relative to a straight line that connects an intersection between a front end portion of the forefoot support portion and a shoe center to a front end portion of the mid- and rear-foot support portion.

8. The sole according to claim 5, wherein:

the forefoot support portion includes a peak portion; and the peak portion is located on an outer side in the foot width direction relative to a straight line that connects an intersection between a front end portion of the forefoot support portion and a shoe center to a front end portion of the mid-and rear-foot support portion.

9. The sole according to claim 5, the midsole including an accommodation portion that defines a space where the plate is accommodated.

10. The sole according to claim 9, wherein the accommodation portion includes:

a bonded portion bonded to the forefoot support portion; and a non-bonded portion formed at a position adjacent to the bonded portion in the foot width direction and not bonded to the forefoot support portion.

11. The sole according to claim 10, wherein the accommodation portion includes:

a contact portion in contact with the forefoot support portion; and a recess portion in a shape recessed from the contact portion in a direction away from the forefoot support portion in the thickness direction.

12. The sole according to claim 9, wherein:

the accommodation portion includes an opposing portion opposed to the forefoot support portion in the foot width direction; and the opposing portion is distant from the forefoot support portion in the foot width direction while a load is not applied to the forefoot support portion.

13. The sole according to claim 9, wherein the accommodation portion includes:

a contact portion in contact with the forefoot support portion; and a recess portion in a shape recessed from the contact portion in a direction away from the forefoot support portion in the thickness direction.

14. A shoe comprising:

the sole according to claim 9; and an upper connected to the sole and located above the sole.

15. The sole according to claim 1, wherein:

the lower midsole includes a lower heel region configured to be superimposed on a heel portion of the wearer in the thickness direction;

the upper midsole includes an upper heel region configured to be superimposed on the heel portion of the wearer in the thickness direction;

a thickness of the lower heel region is larger than a thickness of the upper heel region; and when viewed in cross section in a foot width direction, the mid- and rear-foot support portion has a width that is less than that of the lower midsole.

16. A shoe comprising:

the sole according to claim 15; and an upper connected to the sole and located above the sole.

17. The shoe of claim 16, wherein the forefoot support portion includes a flat shape in a cross-section in the foot width direction.

18. The sole of claim 15, wherein the forefoot support portion includes a flat shape in a cross-section in the foot width direction.

19. The sole according to claim 1, wherein the forefoot support portion includes a flat shape in a cross-section in the foot width direction.

20. The sole according to claim 1, wherein the mid-and rear-foot support portion is in a shape convex upward in a cross-section in a foot width direction throughout an entire area from a position configured to be superimposed on a rear end portion of the metatarsal bone of the wearer in the thickness direction to a position configured to be superimposed on a rear end portion of a heel bone of the wearer.

* * * * *